US008756818B2

(12) United States Patent
Fitraki

(10) Patent No.: US 8,756,818 B2
(45) Date of Patent: Jun. 24, 2014

(54) SHEAR TENSION DEVICE

(71) Applicant: Dino Fitraki, Clearwater, FL (US)

(72) Inventor: Dino Fitraki, Clearwater, FL (US)

(73) Assignee: Fitrakis-Souyias Meriol, Paula Sophia, Macomb, MI (US)

( * ) Notice: Subject to any disclaimer, the term of this patent is extended or adjusted under 35 U.S.C. 154(b) by 0 days.

(21) Appl. No.: 13/656,216

(22) Filed: Oct. 19, 2012

(65) Prior Publication Data

US 2013/0199048 A1 Aug. 8, 2013

Related U.S. Application Data

(60) Provisional application No. 61/595,708, filed on Feb. 7, 2012.

(51) Int. Cl.
*B26B 13/28* (2006.01)

(52) U.S. Cl.
USPC ..... 30/266; 30/254; 30/267

(58) Field of Classification Search
USPC ..... 30/254, 266, 267, 268, 269, 270
See application file for complete search history.

(56) References Cited

U.S. PATENT DOCUMENTS

| | | | | | |
|---|---|---|---|---|---|
| 119,229 | A * | 9/1871 | Grass | 30/266 |
| 135,692 | A * | 2/1873 | Correa | 30/266 |
| 452,260 | A * | 5/1891 | Calahan | 30/266 |
| 826,587 | A * | 7/1906 | Linscott | 30/267 |
| 851,721 | A * | 4/1907 | Witt | 30/268 |
| 887,400 | A * | 5/1908 | Kiser et al. | 30/267 |
| 923,621 | A * | 6/1909 | Bowes | 30/268 |
| 938,630 | A * | 11/1909 | Baur | 30/266 |
| 1,031,370 | A * | 7/1912 | Putney | 30/268 |
| 1,633,441 | A * | 6/1927 | Firth | 30/267 |
| 1,799,950 | A * | 4/1931 | Cartner | 30/270 |
| 2,000,852 | A * | 5/1935 | Langbein | 30/230 |
| 5,628,116 | A * | 5/1997 | Kohno | 30/267 |
| 5,692,305 | A * | 12/1997 | Roskam | 30/254 |
| 5,860,215 | A * | 1/1999 | Roskam et al. | 30/254 |
| 2006/0021230 | A1 * | 2/2006 | Mikami | 30/194 |
| 2007/0124942 | A1 * | 6/2007 | Nenadich et al. | 30/266 |
| 2013/0199048 | A1 * | 8/2013 | Fitraki | 30/254 |

* cited by examiner

*Primary Examiner* — Hwei C Payer
(74) *Attorney, Agent, or Firm* — Gray Robinson, P.A.

(57) ABSTRACT

A shear tension device comprising an adjustment screw and a lock wherein the lock is configured to engage with the adjustment screw and maintain tension properly set by the factory in the shears until service of the shears is required.

1 Claim, 8 Drawing Sheets

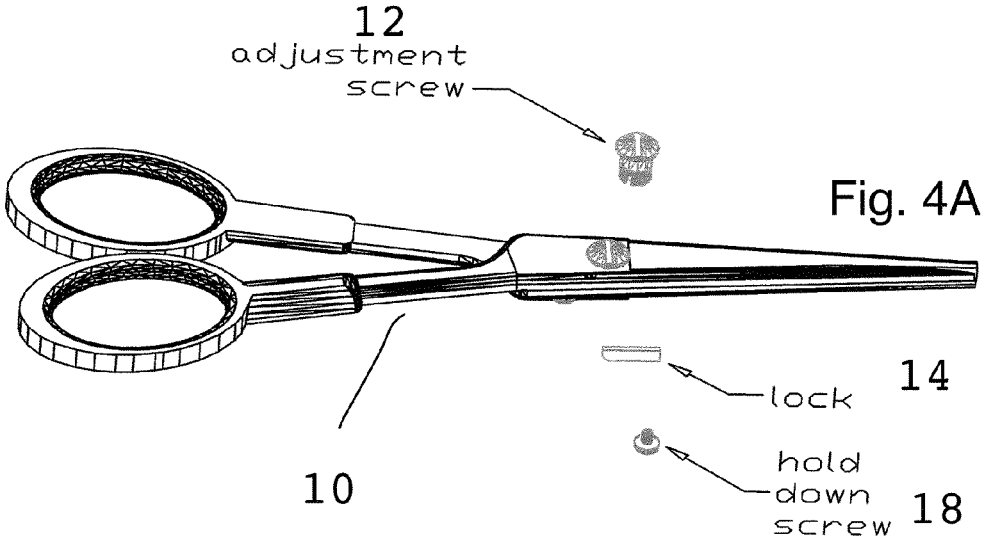
Fig. 4A
Fig. 4B
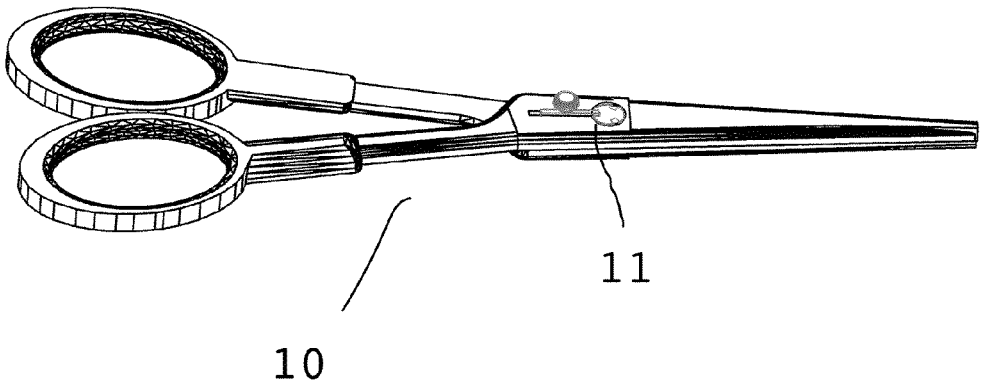

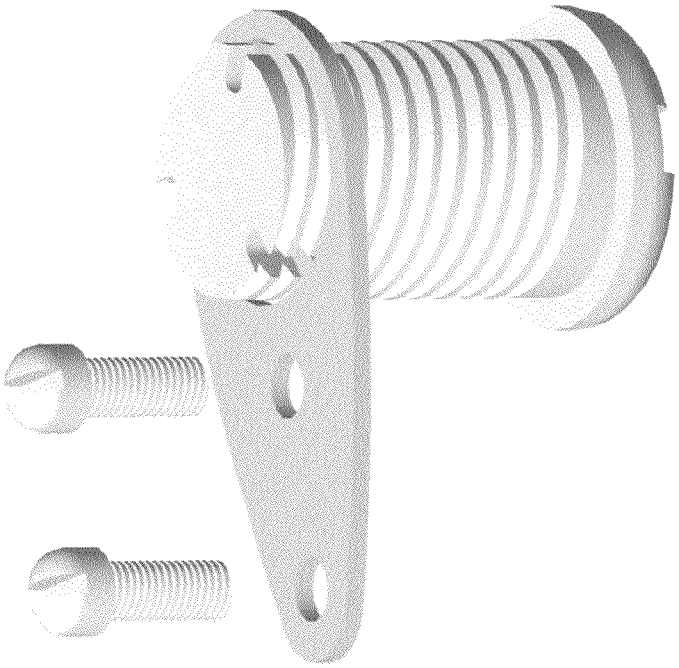
Fig. 5c
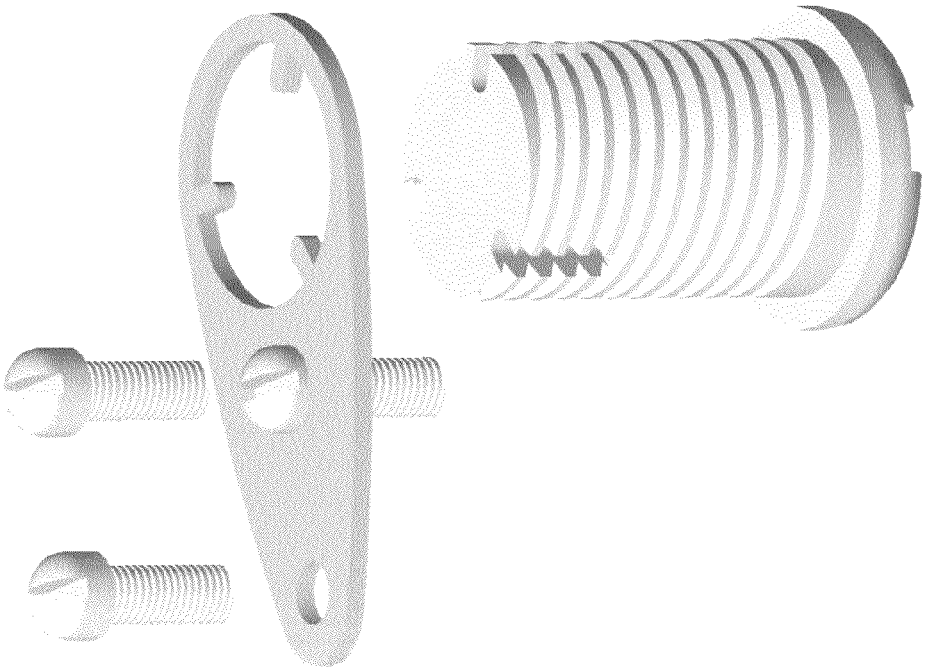

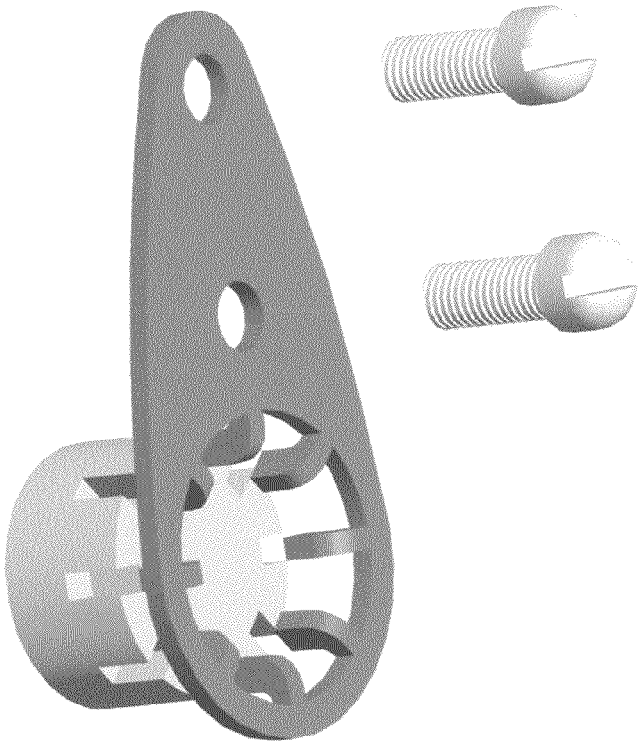
Fig. 5d
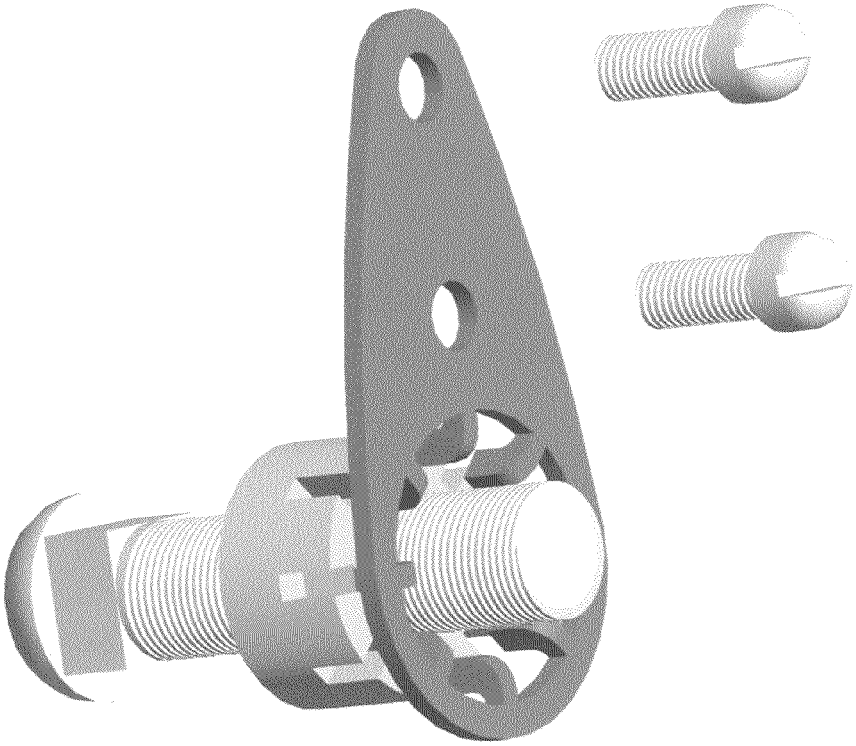

SHEAR TENSION DEVICE

CROSS-REFERENCE TO RELATED APPLICATION

This application claims priority to provisional application, filed Feb. 7, 2012, the entire contents of which are incorporated herein by reference.

BACKGROUND OF THE INVENTION

1. Field of the Invention

This disclosure relates to a shear tension device. More particularly, the present invention relates to a shear tension device for maintaining tension in a set of shears designed to undergo repeated stresses, for instance, in the hair styling industry.

2. Description of the Background Art

Shears are regularly used for cutting various items. For instance, the hair styling industry relies on shears daily. These shears generally include a fastener which connects the two blade members to one another. These shears undergo repeated stresses through their normal daily usage. These stresses test the capability of the fastening device to maintain pressure between the two blades. As the fastening device loosens (as a result of the repeated stresses), the operability of the shears is impacted.

Although each of the above referenced devices is useful in limited instance, they do not provide the ability to further secure the fastening device.

SUMMARY OF THE INVENTION

It is therefore one of the objectives of this disclosure to provide a cost-effective tension device for maintaining tension in a pair of shears throughout repeated usage.

It is also an object of this disclosure to provide a cost-effective tension device for maintaining the tension in a pair of shears.

The present invention provides semi-permanent tension using a shear tension device, which may include an adjustment screw, a hold down screw, an anchor screw and a lock. In one preferred embodiment, the adjustment screw is configured to receive the anchor screw and is integrated with the lock. Thus, tightening of the adjustment screw and anchor screw to the shear (sharpening-reconditioning) serves to provide semi-permanent tension to the shears until the service is provided. The hold down screw may then be utilized to hold the adjustment screw, lock, and anchor screw in place when appropriate tension is applied to the shears.

In another preferred embodiment, the lock includes a mechanism for receiving the hold down screw. In one embodiment, the lock is in a ring configuration.

In another preferred embodiment, the adjustment screw is appropriately knurled or includes other edges designed to receive a portion of the lock.

In another preferred embodiment, the shears include an opening or insert designed to receive the lock.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 4A is a front view of a tension device with an adjustment screw (for instance that may be tightened with a screwdriver), lock, and hold down screw removed from the tension device of the present invention;

FIG. 4B is a bottom view of a tension device depicted in FIG. 4A;

FIG. 5C is a view of a tension device in accordance with an alternate embodiment of the present disclosure FIG. 5D is a view of a tension device in accordance with an alternate embodiment of the present disclosure.

Similar reference characters refer to similar parts throughout the several views of the drawings.

DETAILED DESCRIPTION OF THE PREFERRED EMBODIMENT

Figure 1A:
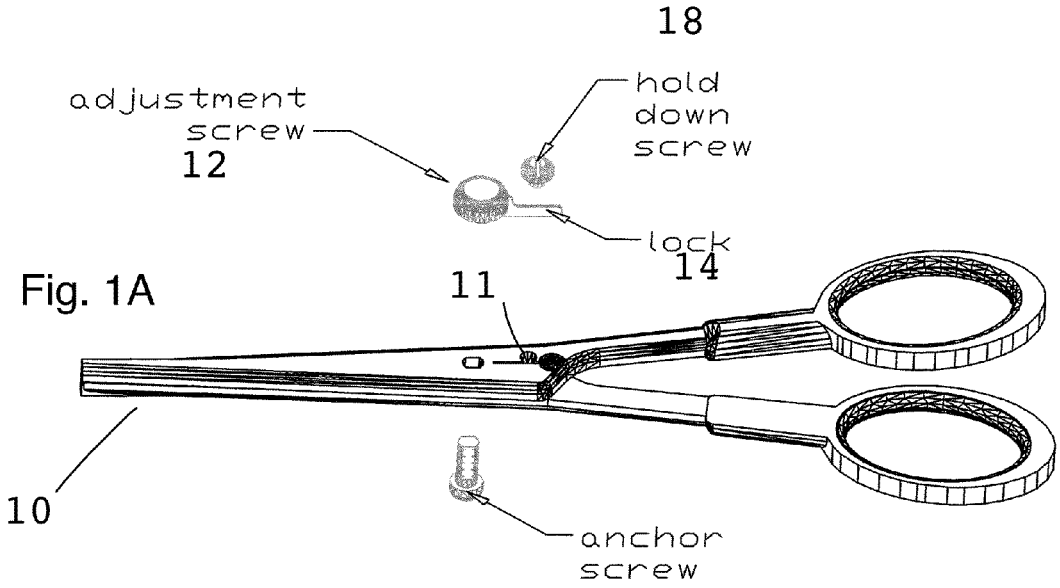
FIG. 1A is a front view of a tension device with an adjustment screw, a hold down screw, a lock lever and an anchor screw removed from the tension device of the present invention.
Figure 1B:
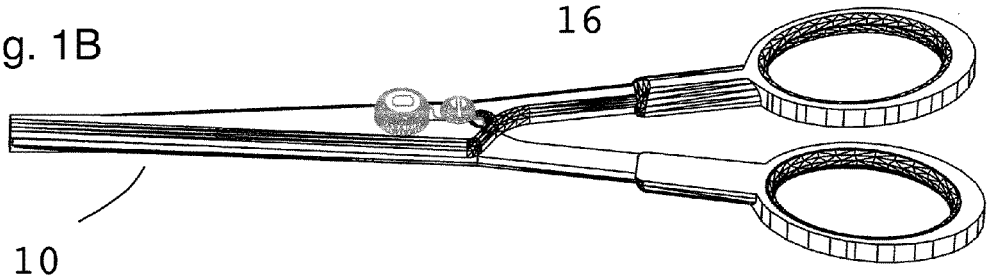
FIG. 1B is a front view of a tension device with an adjustment screw, hold down screw, lock lever, and anchor screw mounted into the tension device of the present invention.

FIGS. 1A and 1B show a shear tension device in accordance with the teachings of the present disclosure in a first preferred embodiment. The shear tension device includes an adjustment nut 12, a hold down screw 18, a lock 14 and an anchor screw 16. The adjustment nut 12 and anchor screw 16 are used in combination to apply pressure to the shears 10 to maintain appropriate cutting tension. The lock 14 may be configured in a rectangular shape as shown in FIG. 1A. The shears 10 may also be designed to receive the lock 14, for instance, by including a groove 11 designed to integrate with the lock 14.

The adjustment nut 12 preferably includes ridges or other appropriate knurling around its periphery so as to provide a mechanism for the lock 14 to engage with during usage. A typical usage scenario is for the factory and serviceman to tighten the adjustment nut 12 and anchor screw 16 to the required tension. The lock 14 would then be inserted into the groove 11 of the shears 10 along its long edge, and into the appropriate ridge of the adjustment nut 12. This serves to keep the adjustment nut 12 in its current place, which maintains tension in the shears 10.The groove 11 may also include a circular opening at its periphery to enable a small device, such as a screw driver or finger nail, to reach under the lock 14 to assist in removal. The hold down screw 18 may then be used to keep the lock 14 in place.

Figure 2A:
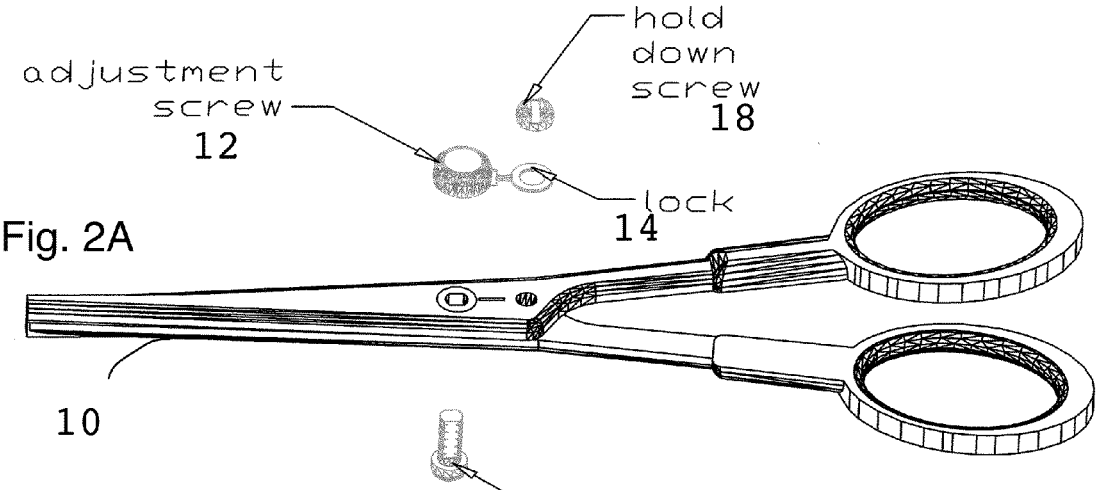
FIG. 2A is a front view of a tension device with an adjustment screw, a hold down lock screw, a circular lock tab, and an anchor screw removed from the tension device of the present invention.
Figure 2B:
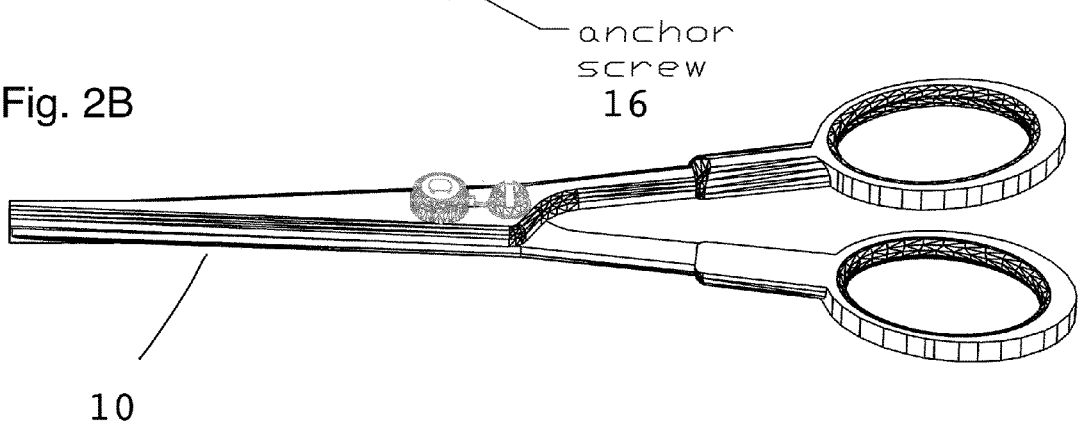
FIG. 2B is a front view of a tension device with an adjustment screw, hold down lock screw, circular lock tab, and anchor screw mounted into the tension device of the present invention.

FIGS. 2A and 2B show a shear tension device in accordance with the teachings of the present disclosure in an alternate embodiment. In this embodiment, the lock tab 14 is designed to receive the hold down lock screw 18 parallel to or behind the lock tab. For instance, the lock 14 may be in a ring configuration. The shears 10 in this embodiment may preferably include a threaded channel for receiving the hold down screw 18. The operation of the shear tension device is as above, with the modification that the lock 14 is held in place by inserting the hold down screw 18 through the lock and into the shears 10.

Figure 3A:
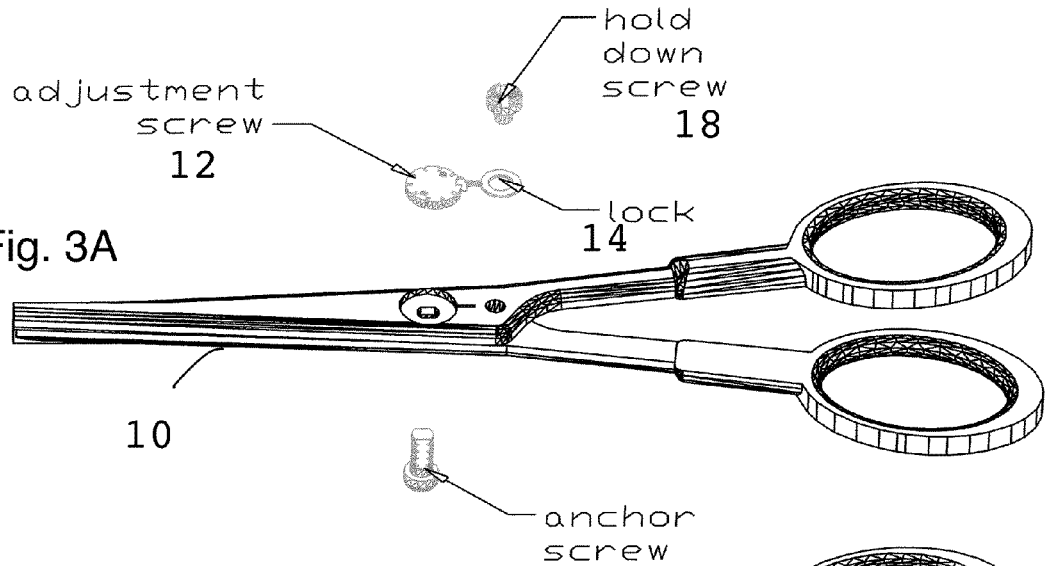
FIG. 3A is a front view of a tension device with an alternative design adjustment screw, hold down screw, circular lock tab and anchor screw removed from the tension device of the present invention.
Figure 3B:
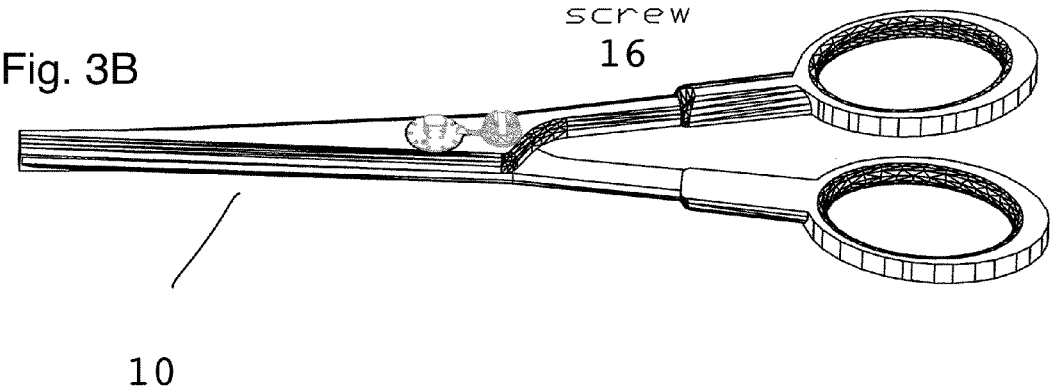
FIG. 3B is a front view of a tension device with an alternative design adjustment screw, hold down screw, circular lock tab, and anchor screw mounted into the tension device of the present invention.

FIGS. 3A and 3B show a shear tension device in accordance with the teachings of the present disclosure in another alternate embodiment. In this embodiment, the adjustment nut 12 is a smaller element, designed to receive the anchor screw 16. This alternate adjustment nut 12 may be used with any locking mechanism 14 under the teachings of the present disclosure.

FIGS. 4A and 4B show a shear tension device in accordance with the teachings of the present disclosure in another alternate embodiment. In this embodiment, an anchor screw is not required because the shear 10 includes a threaded groove (or other similar mechanism) for receiving the adjustment screw. The adjustment nut 12 includes 3 or more ridges or openings on its distal end. The adjustment nut 12 is preferably configured so that when the adjustment screw 12 is engaged with the shears 10 to provide appropriate tension, the adjustment nut 12 extends sufficiently from the opposite side of the shears 10 so as to permit the lock 14 to engage with a ridge of the adjustment nut 12. The shears 10 in this embodiment preferably include ridges or grooves 11 on the surface designed to receive the lock 14. As with above, a hold down bar and screw 18 may be used to keep the lock 14 in place once it is installed.

Figure 5A:
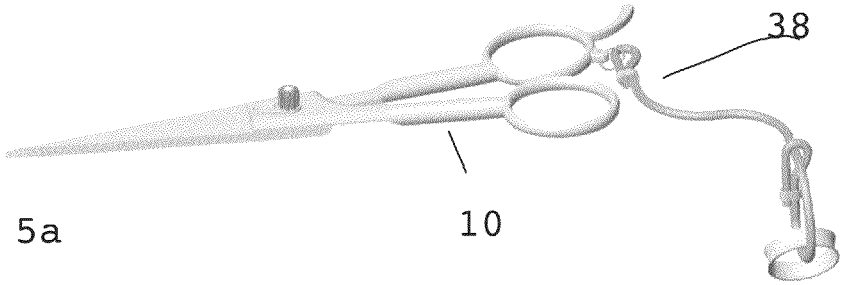
FIG. 5A is a front view of shears used in connection with a tension device and attachment connector in accordance with the present disclosure.
Figure 5E:
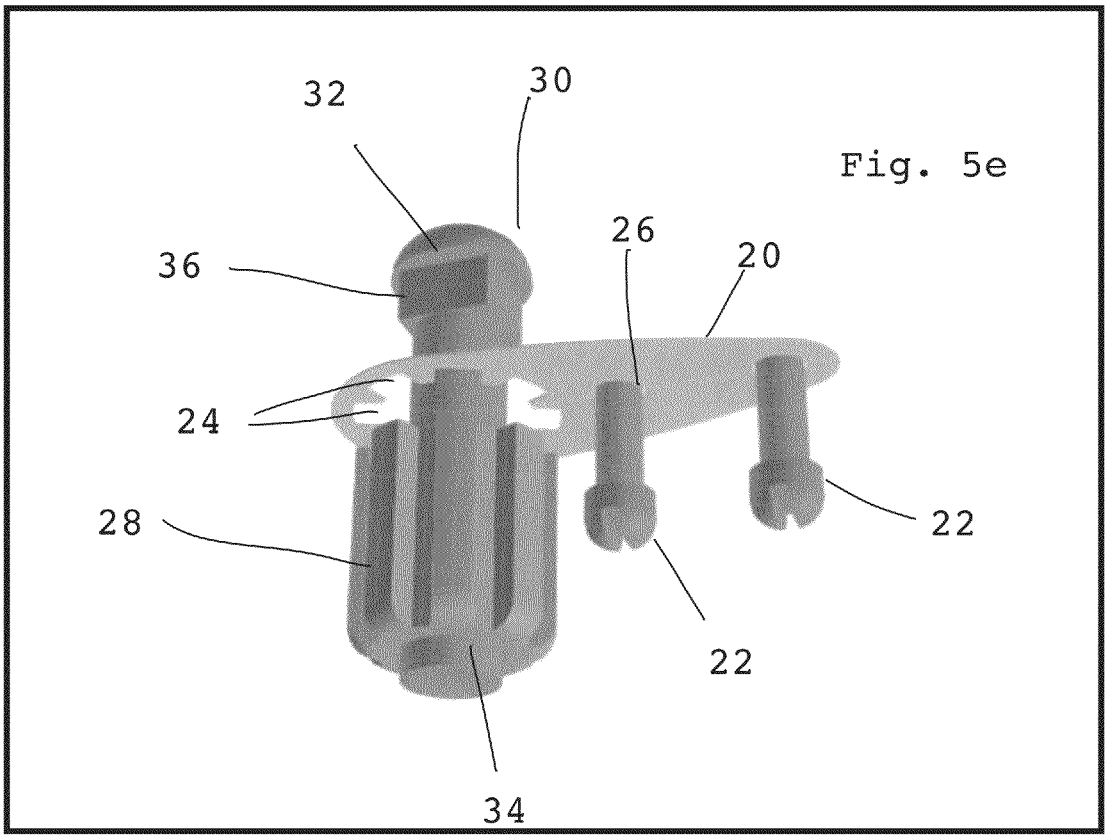
FIG. 5E is a view of a tension device in accordance with an alternate embodiment of the present disclosure.

FIG. 5*a* depicts another alternative embodiment of the present disclosure. The shears 10 may also preferably include a safety strap 38 for attaching the shears to an additional finger of the operator. A larger view of the alternative embodiment is depicted in FIG. 5*e*. The shear tension device includes a locking plate 20 with one or more locking fastener openings 26. Locking fasteners 22 may be inserted through the locking fastener openings 26 and received within channels or openings within the shears 10 so as to attach the locking plate 20 to the shears 10. See FIG. 5*a*. The locking plate 20 may also include an opening for receiving the spindle or adjustment fastener 28. This opening is configured with a number of notches 24 as discussed below.

An anchor fastener 30 may be installed through the shears 10 and serve as the spindle for the shears 10. The anchor fastener 30 includes a head and a member 34. The head may preferably be rounded, and may preferably include a notch to assist in fastening and tightening, for instance with a screwdriver. The member 34 may preferably be a threaded member so that it may be threaded through the shears.

The anchor fastener 30 may also include an anchor fastener box 36. The anchor fastener box 36 may preferably be configured so fit within a recess in one of the members of the shears 10 (not pictured). Thus, when installed, the anchor fastener box 36 serves to hold the anchor fastener in place in relation to the shear 10 member. The anchor fastener 30 may also include an anchor head 32.

Figure 5B:
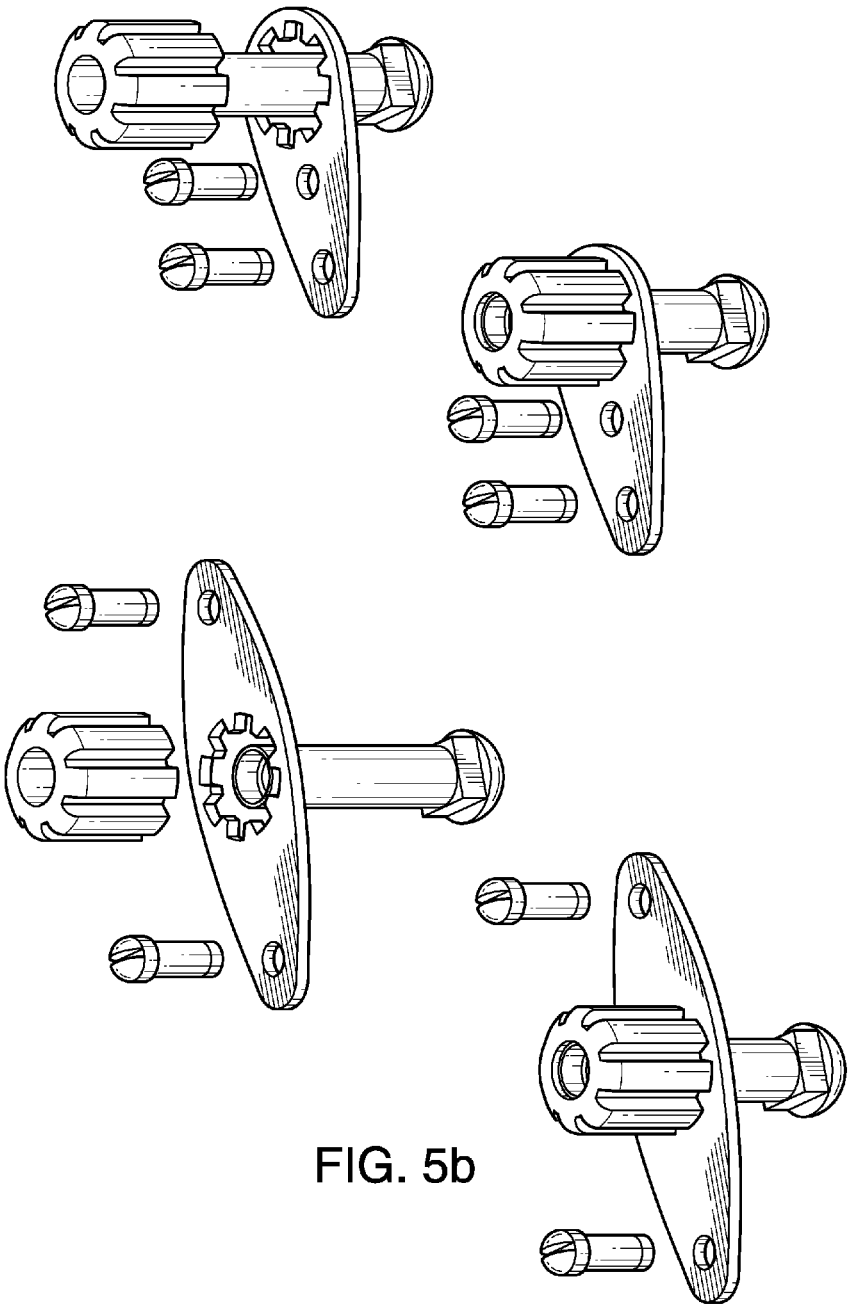
FIG. 5B is a view of a tension device in accordance with an alternate embodiment of the present disclosure.

In the embodiment depicted in FIG. 5*e*, an adjustment fastener 28 is configured to receive the anchor fastener. The adjustment fastener 28 includes a number of notches which correspond to the notches 24 of the locking plate 20. Thus, when installed, the adjustment fastener 28 engages within the notches 24 of the locking plate 20. FIGS. 5*b*, 5*c*, and 5*d* present alternate embodiments in accordance with the present teachings.

As shown in FIG. 5*a*, the shears may also optionally include a rubber, plastic, or other similar material ring and attachment connector. 38. This ring and attachment connector 38 may be used to maintain a connection with the operator's finger. The attachment connector 38 may be disconnected from the shears to permit a larger or smaller ring to be attached therein for the comfort of the operator.

These lock screw systems can be applied in any industry that requires a screw to maintain semi-permanent tension or necessary adjustment until servicing of the tool is required.

The disclosure comprises 4 fastening systems with 4 designs, which include:

1. a hand adjustable nut on the top of the shear;
2. a flat nut on the top of the shear that can be tightened with a special tool;
3. a screw with a screwdriver that threads in the lower shear blade to fasten the shear and lock system applied on the bottom side of the shear. The end of the screw has 3 or more ridges with which to apply the lock; and
4. a locking plate with a number of notches designed to receive an anchor fastener with a number of corresponding notches.

All of the above systems are capable of maintaining semi-permanent tension until such time that the shears require service.

The designs are to be made in the factories, which will adjust the tension of the screws to the correct balance. The lock systems will keep the screws locked at the factory settings until the shears must be sharpened/reconditioned and reset on the proper shear tension.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. A pair of shears comprising:

an anchor screw comprising a threaded member;

first and second articulated elements disposed for movement about the anchor screw;

each of the elements comprising an opening for receiving the anchor screw and comprising respective cutting blades extending in a first direction from the anchor screw and each of the elements comprising a limb extending in a second direction from the anchor screw;

a hold down screw comprising a threaded fastener and a knurled head wherein the head comprises a channel for receiving a screwdriver;

an adjustment nut which includes a knurled head and a locking tab extending perpendicularly from the knurled head wherein the knurled head of the adjustment nut is configured to receive the threaded member of the anchor screw;

the first element further comprising a channel adjacent to the opening and configured to receive the locking tab of the adjustment nut; and the first element further comprising a screw thread receiving member configured to receive the threaded fastener.

* * * * *